US007751763B2

(12) United States Patent
Kaiho

(10) Patent No.: US 7,751,763 B2
(45) Date of Patent: Jul. 6, 2010

(54) IMAGE FORMING APPARATUS

(75) Inventor: Satoshi Kaiho, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 651 days.

(21) Appl. No.: 11/676,559

(22) Filed: Feb. 20, 2007

(65) Prior Publication Data

US 2007/0196142 A1 Aug. 23, 2007

(30) Foreign Application Priority Data

Feb. 20, 2006 (JP) ..... 2006-042770

(51) Int. Cl.
*G03G 15/01* (2006.01)

(52) U.S. Cl. ..... 399/302

(58) Field of Classification Search ..... 399/126, 399/299, 308, 302
See application file for complete search history.

(56) References Cited

U.S. PATENT DOCUMENTS

| | | | | |
|---|---|---|---|---|
| 5,765,082 | A * | 6/1998 | Numazu et al. | 399/299 |
| 6,061,542 | A * | 5/2000 | Minami et al. | 399/299 |
| 6,201,944 | B1 * | 3/2001 | Onuki et al. | 399/299 |
| 6,889,027 | B2 * | 5/2005 | Tachiki et al. | 399/299 |
| 2003/0161667 | A1 * | 8/2003 | Park et al. | 399/299 |
| 2005/0141930 | A1 * | 6/2005 | Murakami et al. | 399/302 |
| 2006/0067745 | A1 * | 3/2006 | Yamada et al. | 399/302 |
| 2007/0059054 | A1 * | 3/2007 | Furukawa | 399/302 |
| 2007/0116496 | A1 * | 5/2007 | Morimoto et al. | 399/299 |
| 2007/0134028 | A1 * | 6/2007 | Funabashi | 399/299 |

FOREIGN PATENT DOCUMENTS

| | | |
|---|---|---|
| JP | 10-293514 | 11/1998 |
| JP | 2005-091725 | 4/2005 |

* cited by examiner

*Primary Examiner*—Susan S Lee
(74) *Attorney, Agent, or Firm*—Turocy & Watson, LLP

(57) ABSTRACT

The image forming apparatus has: a unit including a transfer medium that circularly moves; an image forming section provided along a circulation direction of the transfer medium; a movement mechanism that moves the unit in a direction substantially perpendicular to a moving direction of the transfer medium, and enables the unit to move in a first direction so as to bring the unit into contact with the image forming apparatus and in a second direction so as to move the unit apart from the image forming apparatus; and a cushioning component for applying a load in directions opposite to moving directions of the unit when the unit is moved in the first and second directions, respectively, thereby to relax impact caused by motion of the unit.

20 Claims, 8 Drawing Sheets

IMAGE FORMING APPARATUS

CROSS REFERENCES TO RELATED APPLICATIONS

This application is based on and claims the benefit of priority from the prior Japanese Patent Application No. 2006-42770, filed on Feb. 20, 2006, the entire contents of which are incorporated herein by reference.

BACKGROUND OF THE INVENTION

1. Field of the Invention

The present invention relates to an image forming apparatus such as a printer or a MFP (Multi-Function Peripheral) which is also called a digital composite apparatus.

2. Description of the Related Art

A tandem type image forming apparatus has been known as an image forming apparatus such as a copier or printer. In a tandem type image forming apparatus, plural photosensitive drums are arranged in parallel. Toner images respectively formed on the photosensitive drums are transferred to a paper sheet, multi-layered on the paper sheet, to obtain a color image. An image forming apparatus of this tandem type has an intermediate transfer belt unit.

Jpn. Pat. Appln. Laid-Open Publication No. 10-293514 describes an example of an image forming apparatus having such an intermediate transfer belt unit.

The image forming apparatus in this example has a unit casing, a conveyor mechanism, and an elevation mechanism. The conveyor mechanism has a conveyor belt suspended between first and second rollers provided in the unit casing. The elevation mechanism moves up and down the conveyor mechanism in relation to the unit casing. When replacing the conveyor belt or the like, the conveyor belt is moved away from a photosensitive drum. The elevation mechanism has a cam and a lever, and rotates the cam in accordance with rotation of the lever, thereby moving up and down the conveyor mechanism.

The conveyor belt and the photosensitive drum need to be apart from each other during maintenance services and in contact with each other during use. When the belt and drum are brought into contact with and moved apart from each other by the cam mechanism, peripheral units and members receive impact in some cases. For example, when plural gears are engaged together through such contact, tooth tips of the gears collide with each other to scratch or leave an impact scar on tooth surfaces of the gears. In this case, driving of the mechanism becomes stiff for each cycle, and causes color drifting or jitters in a formed image.

Jpn. Pat. Appln. Laid-Open Publication No. 2005-91725 describes an image forming apparatus implemented with a measure for relaxing impact as described above. In an example of this apparatus, a distant state of a transfer roller in which the roller is apart from an intermediate transfer belt transits to a contact state. Timing of such transition is adjusted so that an end of the transfer roller in the lengthwise direction is brought into contact with the intermediate transfer belt prior to the other end of the transfer roller.

However, the above measure for relaxing impact requires delicate adjustment for transition timing from a distant state to a contact state, and gives rise to a drawback of complex structure.

The present invention provides an image forming apparatus of a tandem type, which includes a mechanism for moving a transfer unit and a photosensitive drum apart from each other and reduces impact generated when a state of the unit and drum being apart from each other transits to a contact state.

DETAILED DESCRIPTION OF THE INVENTION

Throughout this description, the embodiments and examples shown should be considered as exemplars, rather than limitations on the apparatus of the present invention.

An embodiment of the invention will now be described in detail with reference to the drawings.

Figure 1:
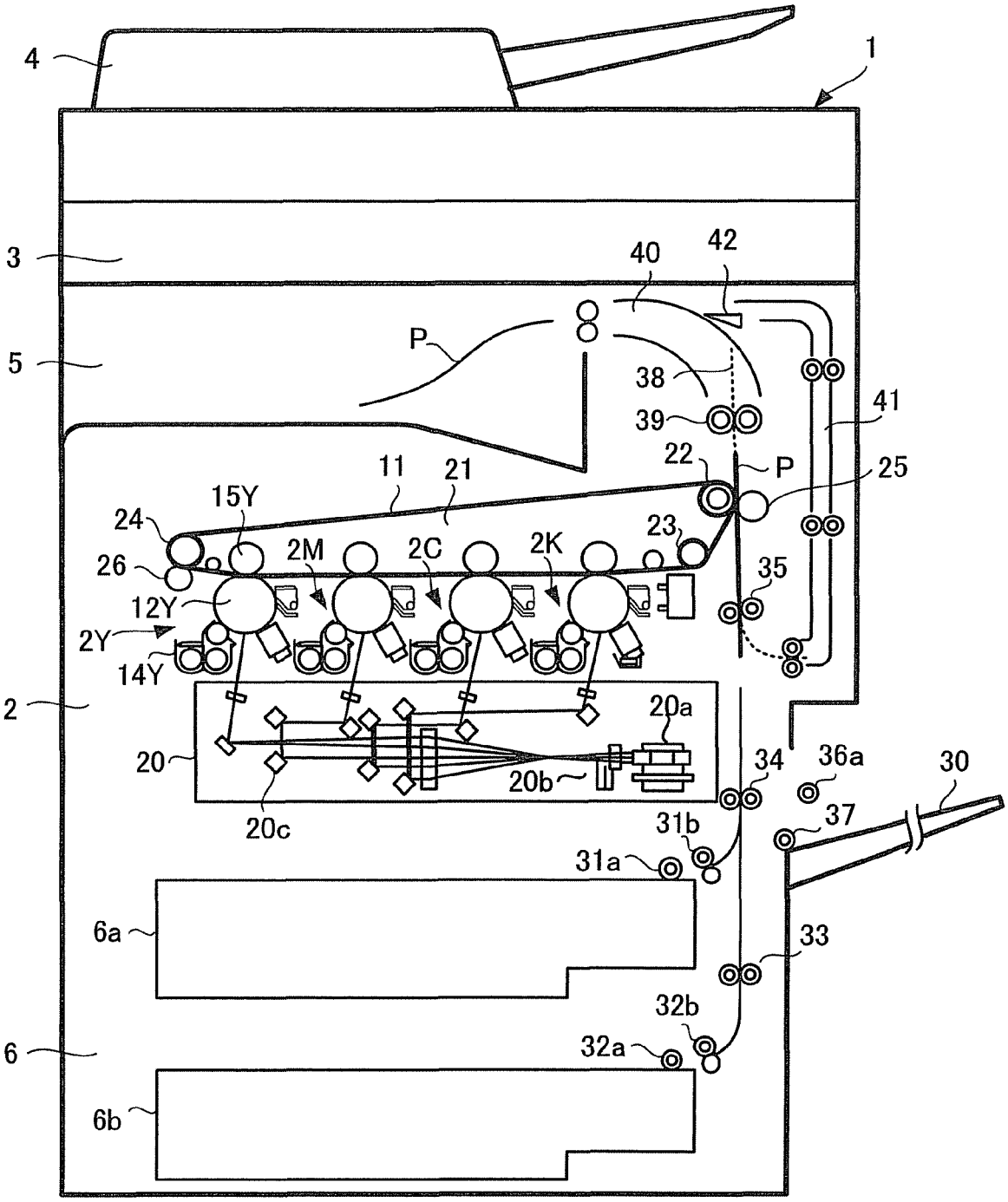
FIG. 1 shows an overall structure of an image forming apparatus according to an embodiment of the present invention.
Figure 2:
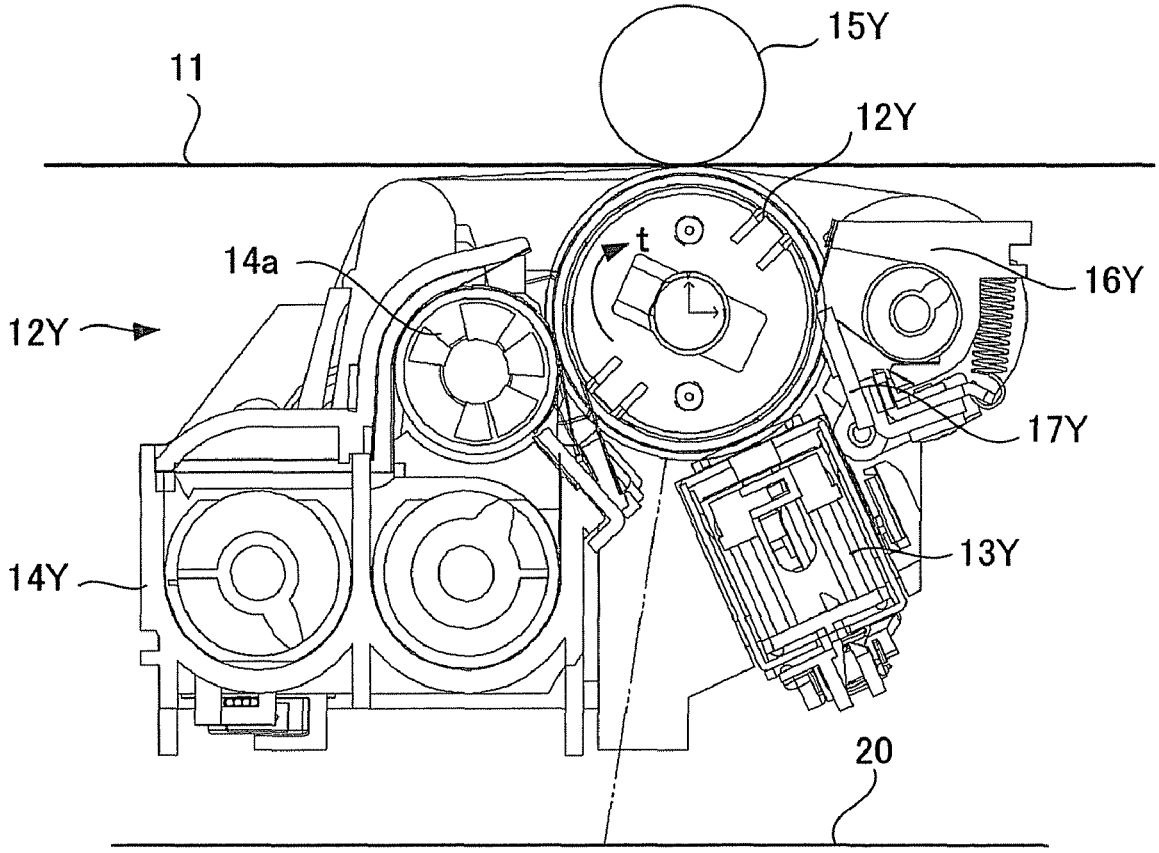
FIG. 2 is an enlarged side view of a part of an image forming section of the image forming apparatus according to the invention.

FIG. 1 shows an internal structure of an image forming apparatus according to an embodiment of the invention. FIG. 2 is an enlarged side view of a part of FIG. 1. The following description will be made with reference to an example of a MFP (Multi-Functional Peripheral) as a composite apparatus. The invention is applicable to other image forming apparatuses such as printers, etc.

In FIG. 1, an image forming apparatus 1 has an image forming section 2 located in a middle part of the apparatus. An image reader section 3, an automatic document feeder (ADF) 4, and a sheet output section 5 are provided in upper parts of the image forming apparatus 1. The image forming apparatus 1 has an operation section and a display section in an upper part of the image forming apparatus 1 although the operation and display sections are omitted from the drawings. At a lower part of the image forming apparatus 1, a sheet feeder section 6 is provided.

The automatic document feeder 4 feeds a document to the image reader section 3, which reads the document and generates image data.

The image forming section 2 is constituted by, for example, a tandem type color laser printer, and scans a photosensitive member with a laser beam from a laser exposure device 20, to form an image.

The image forming section 2 includes image forming sections 2Y, 2M, 2C, and 2K for colors of yellow (Y), magenta (m), cyan (c), and black (K), respectively. The image forming sections 2Y, 2M, 2C, and 2K are arranged in parallel from the upstream side to the downstream side, below an intermediate transfer belt 11 as an intermediate transfer medium.

In the following description, components forming the image forming sections 2Y, 2M, 2C, and 2K will be denoted at reference numerals added with Y, M, C and K, respectively. In some cases, the components will be described omitting the reference numerals Y, M, C and K.

Since the image forming sections 2Y, 2M, 2C and 2K have the same structure, only the image forming section 2Y will be described below as a representative examples of the image forming sections. The image forming section 2Y has a photosensitive drum 12Y. An electric charger 13Y, a developing device 14Y, a transfer roller 15Y, a cleaner 16Y, a blade 17Y, and the like are located around the photosensitive drum 12Y. Details of the structure of the image forming section 2Y is shown enlarged in FIG. 2.

The intermediate transfer belt 11 circularly moves, and semiconductive polyimide is used for the belt in view of heat resistance and abrasion resistance. The intermediate transfer belt 11 is suspended over a driving roller 22 and driven rollers 23 and 24. The intermediate transfer belt 11 can have contact with photosensitive drums 12Y to 12K. To a position of the intermediate transfer belt 11 where the belt faces the photosensitive drum 12Y, a primary transfer voltage of +1,000 V or so is applied from a primary transfer roller 15Y so that a toner image on the photosensitive drum 12Y is primarily transferred to the intermediate transfer belt 11.

A secondary transfer roller 25 is located so as to face the driving roller 22 suspending the intermediate transfer belt 11. When a paper sheet P passes between the driving roller 22 and the secondary transfer roller 25, a secondary transfer voltage of +1,000 V or so is applied from the secondary transfer roller 25, so that toner images on the intermediate transfer belt 11 are secondarily transferred to the paper sheet P. A belt cleaner 26 is provided near the driven roller 24 for the intermediate transfer belt 11.

FIG. 2 shows enlarged one of the image forming sections 2Y, 2M, 2C, and 2K. Referring to the image forming section 2Y as an example, an electric charger 13Y, a developing device 14Y, a primary transfer roller 15Y, a cleaner 16Y, a blade 17Y, and the like are provided around the photosensitive drum 12Y. To an exposure position of the photosensitive drum 12Y, a yellow laser beam is emitted from a laser exposure device 20, to form a latent image on the photosensitive drum 12Y.

In each of the image forming sections 2Y to 2K, the electric charger 13 electrically charges uniformly the whole surface of the photosensitive drum 12 to, for example, −700 V or so. The developing device 14 supplies the photosensitive drum 12 with a two-component developer by a developing roller 14*a* which is applied with a developing bias of −500 V or so. The two-component developer contains toner of one corresponding color and a carrier. The cleaner 16 removes residual toner on the surface of the photosensitive drum 12 by use of the blade 17.

Meanwhile, the laser exposure device 20 scans the photosensitive drum 12 in an axial direction of the drum with a laser beam emitted from a semiconductor laser element. The laser exposure device 20 includes a polygon mirror 20*a*, an imaging lens system 20*b*, a mirror 20*c*, and the like.

The sheet feeder section 6 has plural sheet feeder cassettes 6*a* and 6*b* to contain paper sheets of various sizes. The image forming apparatus 1 further has a manual feed tray 30 for manually feeding paper sheets.

Between the sheet feeder cassettes 6*a* and 6*b* and the secondary transfer roller 25, there are provided pickup rollers 31*a* and 32*a*, separation rollers 31*b* and 32*b*, conveyor rollers 33 and 34, and a resist roller 35. The pickup rollers 31*a* and 32*a* pick out paper sheets from inside the sheet feeder cassettes 6*a* and 6*b*. Between the manual feed tray 30 and the resist roller 35, there are provided a pickup roller 36*a* for picking up paper sheets P, and a manual sheet feed roller 37.

Further, a fixing device 39 is provided in the downstream side of the secondary transfer roller 25 along a vertical path 38 for vertically conveying paper sheets P fed from the sheet feeder cassettes 6*a* and 6*b* or the manual feed tray 30.

Between the fixing device 39 and the sheet output section 5, there are provided a sheet output conveyor path 40 and a reverse conveyor path 41. A gate 42 is provided on the reverse conveyor path 41 to distribute paper sheets P to the sheet output section 5 or to the reverse conveyor path 41. The reverse conveyor path 41 reverses and guides paper sheets P in a direction toward the secondary transfer roller 25. The reverse conveyor path 41 is used when carrying out double-sided printing.

Operation of the image forming apparatus shown in FIGS. 1 and 2 will be described next. As image forming is started, image information is inputted from a scanner, personal computer terminal, or the like. Then, photosensitive drums 12 rotate and the image forming sections 2Y to 2K sequentially form images.

Referring to the image forming section 2Y as an example, the photosensitive drum 12Y is irradiated with a laser beam in accordance with image information for yellow (Y), thereby forming an electrostatic latent image. From the electrostatic latent image, a toner image for yellow (Y) is formed by the developing device 14Y. Subsequently, the photosensitive drum 12Y makes contact with the intermediate transfer belt 11 being rotated, thereby primarily transferring the toner image for yellow (Y) to the intermediate transfer belt 11 by the primary transfer roller 15Y.

In a similar manner to the toner image forming process for yellow (Y), toner images for magenta (M), cyan (C), and black (K) are formed by the image forming section 2M, 2C, and 2K, and are sequentially transferred to the same position on the intermediate transfer belt 11 as the toner image for yellow (Y) has been formed. Thus, toner images for yellow (Y), magenta (M), cyan (C), and black (K) are transferred to the intermediate transfer belt 11, multi-layered on one another, so that a full color toner image is obtained.

Further, the intermediate transfer belt 11 secondarily transfers the full color toner image all at once to a paper sheet P by a transfer bias of the secondary transfer roller 25. The paper sheet P is fed to the position of the secondary transfer roller 25 from the sheet feeder cassettes 6*a* or 6*b* or the manual feed tray 30, synchronized with timing when the full color toner image on the intermediate transfer belt 11 reaches the secondary transfer roller 25. The paper sheet P to which the toner image has been secondarily transferred reaches a fixing roller 39, and the toner image is fixed.

In case of printing an image only on one side (single-sided printing), the paper sheet P is distributed to the sheet output section 5 by the gate 42. Otherwise, in case of double-sided printing or multi-layered printing, the paper sheet P is distributed to the reverse conveyor path 41 and conveyed again to the secondary transfer roller 25.

After completion of the secondary transfer, residual toner is cleaned from the intermediate transfer belt 11 by the belt cleaner 26. From each photosensitive drum 12, residual toner is cleaned by the cleaner 16 and blade 17 after primary transfer of a toner image to the intermediate transfer belt 11, to become ready for next image forming.

The blade 17 is in contact with the photosensitive drum 12. As the photosensitive drum 12 rotates, the blade 17 finely scrapes away a coating on the photosensitive drum 12 and an edge of the blade 17 itself is abraded. The process as described above is repeated so that an amount of abrasion of the photosensitive drum 12 or blade 17 exceeds a certain amount, and desired performance cannot be achieved. In other words, lifecycle of the photosensitive drum 12 or blade 17 depends on total operation period.

Therefore, the photosensitive drum 12 and primary transfer roller 15 are located away from each other (for example, at color image forming sections during monochrome character printing) in order to extend lifecycle except for some unavoidable part.

Figure 3:
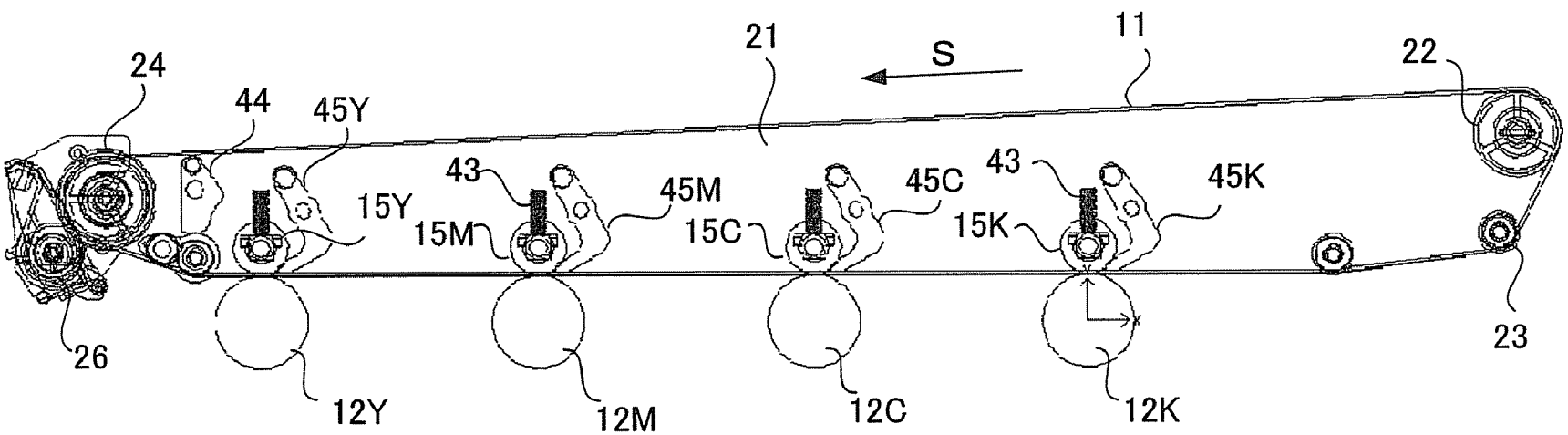
FIG. 3 is a side view showing a structure of a transfer unit in the image forming apparatus according to the invention.

FIG. 3 schematically illustrates a structure of a transfer unit 21 including a transfer belt 11. The transfer belt 11 is driven by a driving roller 22 to travel in the direction of an arrow S. A bias is applied to primary transfer rollers 15Y to 15K located at positions where the rollers face the photosensitive drums 12Y to 12K. Toner images developed on the photosensitive drums 12Y to 12K are transferred to the transfer belt 11. At this time, each of the primary transfer rollers 15 is pressed against the photosensitive drum 12 so as to form a constant nip by dead weight of the roller and pressure from a spring 43.

The same process as described above is carried out to form a toner image by each of the image forming sections 2Y to 2K for respective colors. Toner images for respective colors are layered on one another to form a color image. After forming the image, residual toner on the transfer belt 11 is cleaned by the belt cleaner 26.

When no color image is formed, e.g., when monochrome text information is formed, toner consumption can be reduced by developing only a latent image for black (K) In this case, the other color image forming sections 2Y, 2M, and 2C than the image forming section 2K should desirably not operated because lifecycle of each image forming section 2 depends on a total operation period.

If the transfer belt 11 is rotated in contact with the photosensitive drums 12 under pressure applied by primary transfer, the photosensitive drums 12 and the transfer belt 11 are abraded or damaged. Therefore, a mechanism for moving the transfer belt 11 apart from the photosensitive drums 12 is required.

A cam 44 and lifters 45Y, 45M, 45C, and 45K lift up the primary transfer rollers 15Y to 15K upon necessity, respectively, so as to leave the transfer belt 11.

Meanwhile, during a maintenance service for inspecting, repairing, or replacing a component, the whole transfer unit 21 needs to be moved apart from the photosensitive drums 12. Therefore, the invention employs a separation mechanism for moving the whole transfer unit 21 apart from the photosensitive drums 12 and bringing the unit 21 into contact with the drums 12.

Figure 4:
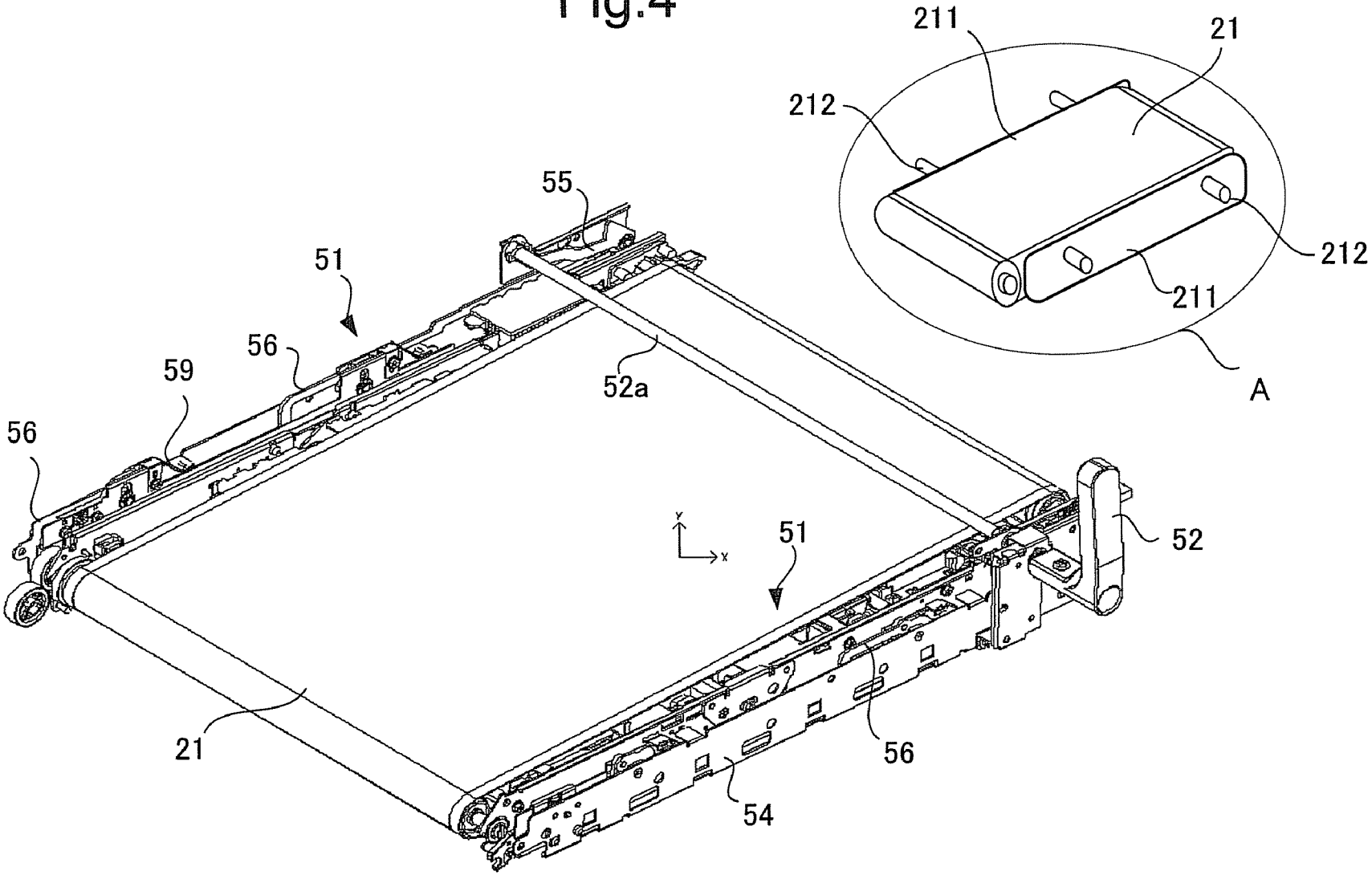
FIG. 4 is a perspective view showing a separation mechanism of the transfer unit in the image forming apparatus according to the invention.
Figure 5A:
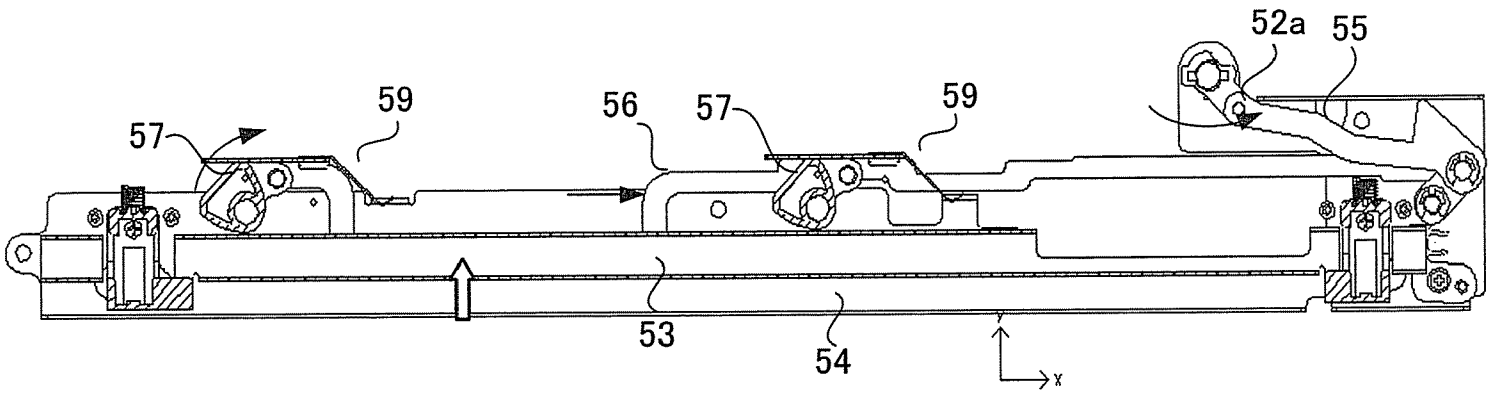
FIG. 5A and FIG. 5B are side views depicting operation of the separation mechanism in the image forming apparatus according to the invention.
Figure 5B:
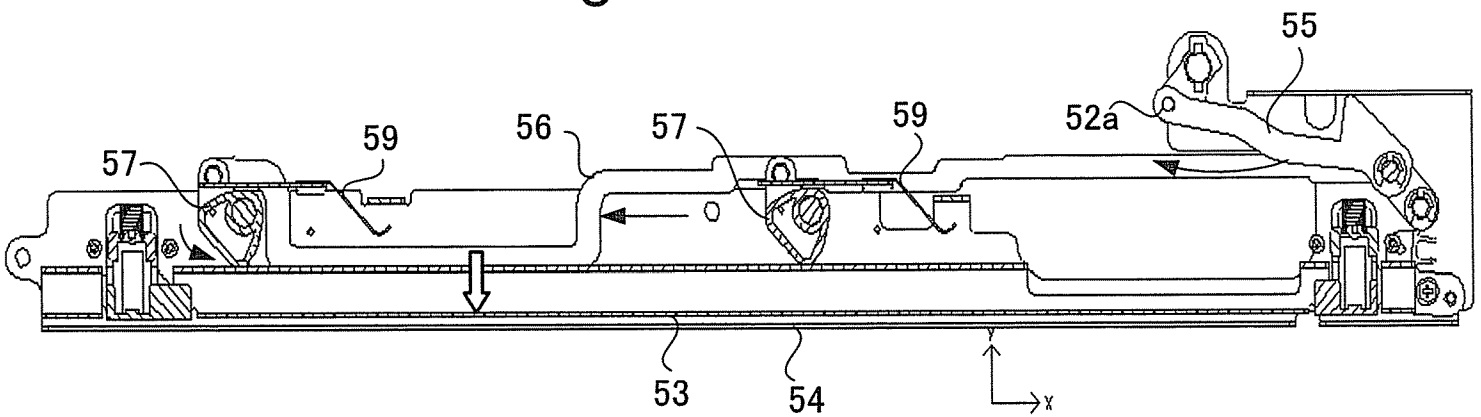

FIG. 4 is a perspective view showing the separation mechanism for the transfer unit 21 in the image forming apparatus according to the invention. FIGS. 5A and 5B are side views for explaining the structure and operation of the separation mechanism.

In FIG. 4, the transfer unit 21 is held by a unit holder mechanism 51 configured in a laterally symmetrical structure. The unit holder mechanism 51 is moved up and down by rotating a handle 52, so as to move the transfer unit 21 apart from and into contact with the photosensitive drums 12.

The transfer unit 21 has support pins 212 which are attached to a frame 211 and protrude outward from the frame 211, as schematically illustrated within a circle A in FIG. 4. The support pins 212 are engaged in fixed rails 53 of the unit holder mechanism 51. As the fixed rails 53 are elevated up and down by operating the handle 52, the whole transfer unit 21 is elevated up and down.

Figure 6:
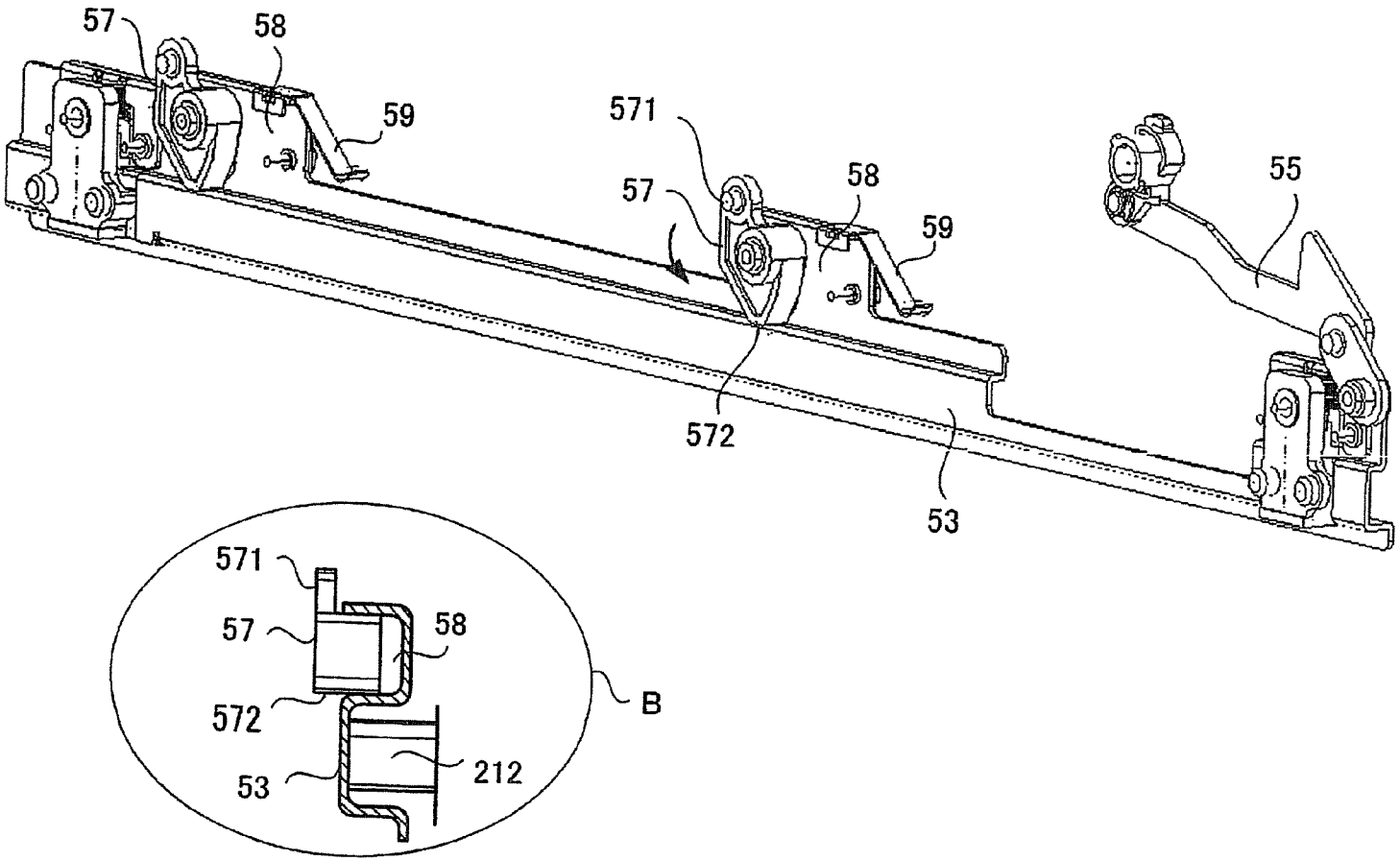
FIG. 6 is a perspective view showing a structure of a major part of the separation mechanismin the image forming apparatus according to the invention.

Although the fixed rails 53 are hidden behind frames 54 in FIG. 4, a fixed rail 53 is shown enlarged in FIG. 6. The following description will be made referring to FIG. 6 along with FIG. 4.

The unit holder mechanism 51 includes frames 54, a handle 52, an elevation links 55, link rods 56, and cams 57. The frames 54 are attached to the body of the image forming apparatus. The elevation links 55 are attached respectively to two sides of the handle shaft 52*a* which rotates as the handle 52 rotates. The link rods 56 move in lateral directions of the drawings as the elevation links 55 rotate. The cams 57 rotate as the link rods 56 move.

The fixed rails 53 each have a recessed cross-section in order to engage the support pins 212. A container section 58 for receiving a cam 57 is formed at a ceiling section of each recessed section. More specifically, as illustrated enlarged in a circle B in FIG. 6, each fixed rail 53 is partially bent so as to form an S-shaped cross-section.

The cams 57 each have a rotating shaft fixed to the body of the image forming apparatus 1. The cams 57 each lift up the ceiling section of the container section 58 or push down a bottom section of the container section 58, thereby to move up or down the whole fixed rails 53.

A spring 59 is attached to the ceiling section of each container section 58. The spring 59 makes contact with a protrusion 60 provided on the body of the image forming apparatus 1 when the fixed rails 53 move down. When the fixed rails 53 are going to move down, tip ends of the springs 59 are brought into contact with the protrusions 60. The fixed rails 53 are thereby energized by the springs 59 so as to lift up in an upward direction. Therefore, the cams 57 push down the fixed rails 53 against the biasing force of the springs 59.

Described next will be elevation operation of the transfer unit 21 by the unit holder mechanism 51. When the transfer unit 21 is set down, the transfer unit 21 is in contact with the photosensitive drums 12. When the transfer unit 21 is set up, the transfer unit 21 is apart from the photosensitive drums 12.

FIG. 5A shows a state in which the transfer unit 21 has lifted up apart from the photosensitive drums 12 wherein the elevation links 55 have been pulled back toward a rear side as shown in FIG. 4. In this state, the cams 57 are rotated rightward by the link rods 56 and lift up the fixed rails 53.

Figure 7A:
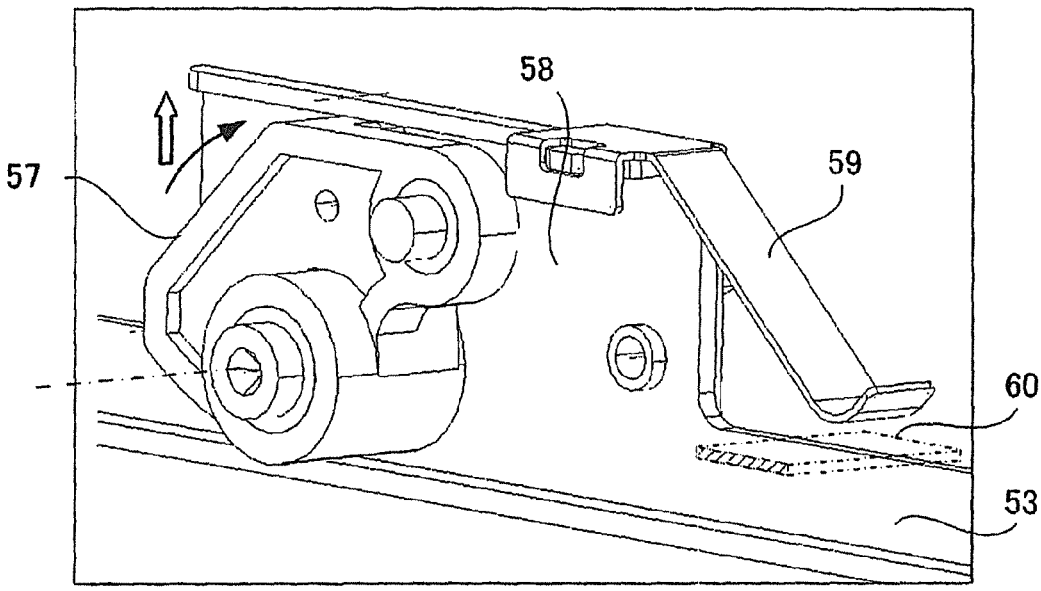
FIGS. 7A and 7B are perspective views depicting operation of a major part of the separation mechanism shown in FIG. 6.

FIG. 7A shows a state in which the cams 57 have lifted up the ceiling sections of the container sections 58. Accordingly, the transfer unit 21 is apart from the photosensitive drums 12.

The cams 57 are eccentric cams which have rotating points located on the body of the image forming apparatus as illustrated in FIG.6. Each cam 57 rotates with an end 571 of the cam 57 linked to a link rod 56 and with another end 572 kept in contact with a container section 58 of a fixed rail 53.

FIG. 5B shows a state in which the transfer unit 21 has moved down making contact with the photosensitive drums 12 wherein the elevation links 55 have pushed forward the link rods 56 toward a front side as shown in FIG. 4. In this state, the cams 57 are rotated leftward by the link rods 56 and push down the fixed rails 53.

Figure 7B:
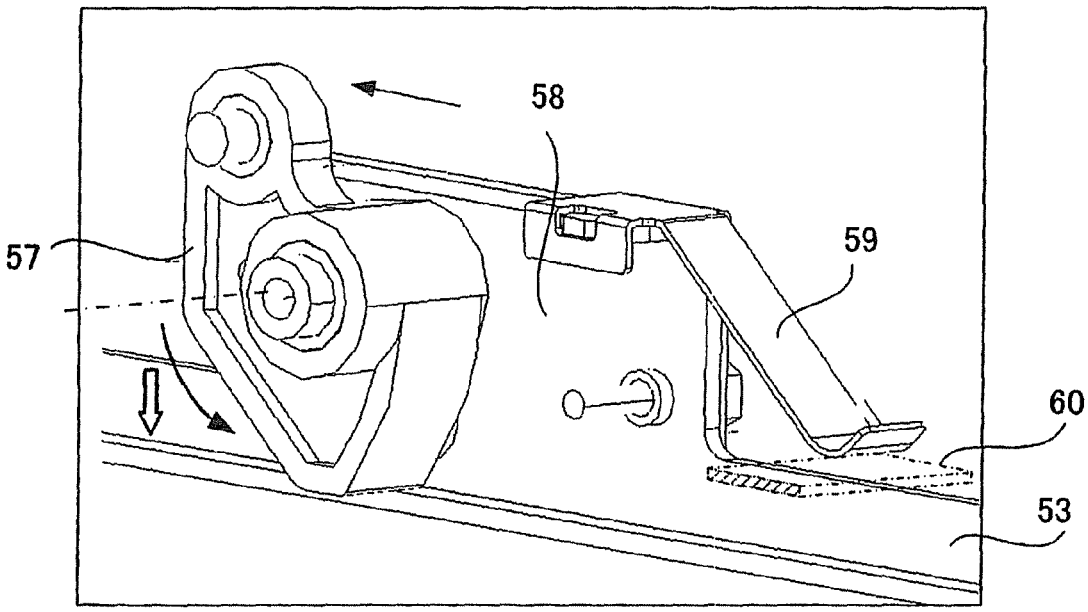

FIG. 7B shows a state in which the cams 57 have pushed down the bottom sections of the container sections 58. Accordingly, the transfer unit 21 is in contact with the photosensitive drums 12.

When to lift up the fixed rails 53, the cams 57 lift up the fixed rails 53 against the dead weight of the fixed rails 53 (i.e., against gravity). When to move down the fixed rails 53, the cams 57 push down the fixed rails 53 against the biasing force of the springs 59.

Therefore, the fixed rails 53 move up and down continuously kept in contact with the cams 57. Accordingly, a cushioning effect is generated when the fixed rails 53 move up or down, and prevents the transfer unit 21 from abruptly moving apart from or into contact with the fixed rails 53. That is, the springs 59 and the gravity of the fixed rails 53 constitute a load means which continuously applies a load to the cams in a direction opposite to an upward or downward moving direction of the fixed rails 53 when the fixed rails 53 are moved up or down by rotation of the cams 57.

Figure 8:
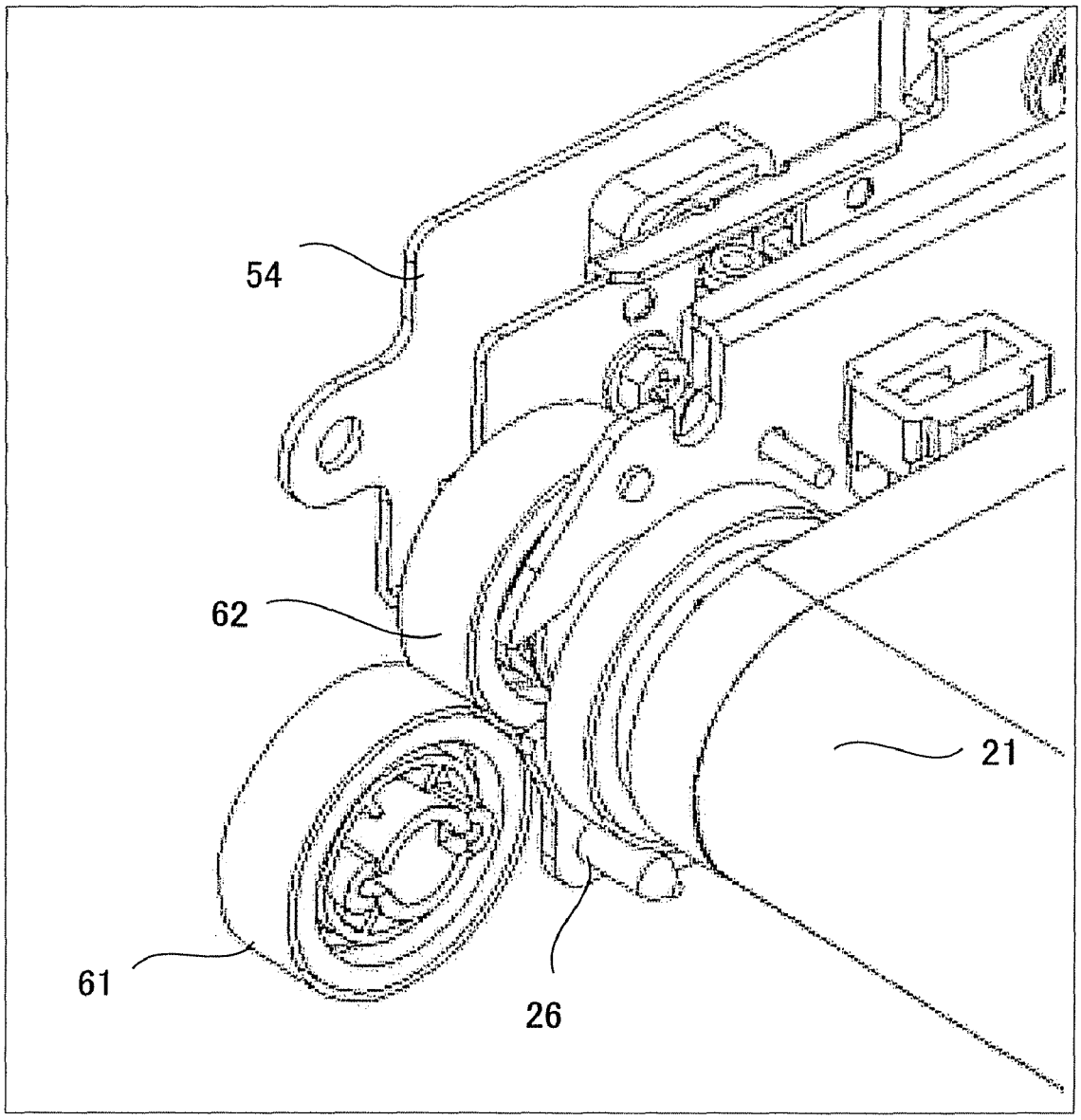
FIG. 8 is an enlarged perspective view showing a part of a rotation drive mechanism of the transfer unit in the image forming apparatus according to the invention.

FIG. 8 is a perspective view showing a gear structure of the transfer unit 21 for driving the transfer belt 11. To rotate the transfer belt 11, a drive gear 61 is provided on the body, and a gear 62 is provided on the transfer unit 21 so as to engage with the driver gear 61.

When the transfer unit 21 is brought into contact with the fixed rails 53 after once moving apart from the fixed rails 53, the gears 61 and 62 are engaged with each other. If impact occurs when the transfer unit 21 is brought into contact, tooth tips of the gears collide with each other and leave impact scars on tooth surfaces. If an impact scar is left, irregular rotation is caused and results in a defect such as a jitter in a formed image. However, the present invention is capable of relaxing impact caused by moving the transfer unit 21 apart from or into contact with the fixed rails 53 by means of the cams 57 and springs 59 When the fixed rails 53 are set down completely, the cams 57 position the fixed rails 53 in the lower side of the cams 57. Therefore, the transfer unit 21 can form images without receiving influence such as vibration.

Thus, the image forming apparatus according to the present invention relaxes impact which is caused when moving the transfer unit. Accordingly, malfunctions and defective images can be prevented.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. An image forming apparatus comprising:

a unit including a transfer medium that circularly moves;

an image forming section provided along a circulation direction of the transfer medium;

a movement mechanism that moves the unit in a direction substantially perpendicular to a moving direction of the transfer medium by use of rotation of a cam, and enables the unit to move in a first direction so as to bring the unit into contact with the image forming apparatus and in a second direction so as to move the unit apart from the image forming apparatus; and a cushioning member for applying a load to the cam in directions opposite to moving directions of the unit when the unit is moved by the rotation of the cam in the first and second directions, respectively, thereby to relax impact caused by motion of the unit.

2. The image forming apparatus according to claim 1, wherein the image forming apparatus includes plural photosensitive drums arranged in parallel with each other from an upstream side to a downstream side along the circulation direction of the transfer medium, and an image formed on at least one of the plural photosensitive drums is transferred to the transfer medium with the unit and the image forming apparatus kept in contact with each other.

3. The image forming apparatus according to claim 1, further comprising:

a first gear as a drive source provided in a body of the image forming apparatus; and a second gear provided in the unit to rotate circularly the transfer medium, wherein when the unit is brought into contact with the image forming section, the first and second gears are smoothly engaged with each other by the cushioning member.

4. An image forming apparatus comprising:

a transfer unit including an intermediate transfer medium that circularly moves;

an image forming section including plural photosensitive drums arranged in parallel with each other from an upstream side to a downstream side along a circulation direction of the intermediate transfer medium;

a movement mechanism that moves an entire of the transfer unit in a direction substantially perpendicular to a moving direction of the intermediate transfer medium by use of rotation of a cam, and enables the transfer unit to move in a first direction so as to bring the transfer unit into contact with the photosensitive drums and in a second direction so as to move the transfer unit apart from the photosensitive drums; and a load member that is provided in the movement mechanism and continuously applies a load to the cam in directions opposite to moving directions of the transfer unit when the transfer unit is moved in the first and second directions, respectively, by the rotation of the cam.

5. The image forming apparatus according to claim 4, wherein the load member includes a biasing member for applying a load to the cam when the transfer unit is moved in the first direction by the cam.

6. The image forming apparatus according to claim 5, wherein the biasing member is constituted by a spring member.

7. The image forming apparatus according to claim 4, wherein the movement mechanism includes:

a link member that can move in a third direction along a moving direction of the intermediate transfer medium in accordance with rotation of a handle;

the cam that rotates in accordance with motion of the link member and has a rotating point located on a body of the image forming apparatus;

a rail member that is attached to the body of the image forming apparatus, supports the transfer unit from two sides of the transfer unit along the moving direction of the intermediate transfer medium, has a container section for containing the cam, and is movable in the first or second direction by rotating of the cam.

8. The image forming apparatus according to claim 7, wherein the cam is constituted by an eccentric cam that has an end connected to the link member and another end in contact with the rail member, with the rotating point as a center.

9. The image forming apparatus according to claim 7, wherein the container section provided in the rail member has a ceiling section and a bottom section with which the cam makes contact, and the container section pushes up and down the ceiling section as the cam pivots, thereby moving the rail member.

10. The image forming apparatus according to claim 4, further comprising:

a first gear as a drive source provided in a body of the image forming apparatus; and a second gear provided in the transfer unit to rotate circularly the intermediate transfer medium, wherein when the transfer unit is brought into contact with the image forming section, the first and second gears are smoothly engaged with each other by the load member.

11. An image forming apparatus having a transfer unit including an intermediate transfer medium that circularly moves, and an image forming section including plural photosensitive drums arranged in parallel with each other from an upstream side to a downstream side along a circulation direction of the intermediate transfer medium, the transfer unit being movable in a first direction so as to bring the transfer unit into contact with the photosensitive drums and in a second direction so as to move the transfer unit apart from the photosensitive drums, and the image forming apparatus comprising:

a link member that can move in a third direction along a moving direction of the intermediate transfer medium in accordance with rotation of a handle;

a cam that rotates in accordance with motion of the link member and has a rotating point located on a body of the image forming apparatus;

a rail member that is attached to the body of the image forming apparatus, supports the transfer unit from two sides of the transfer unit along the moving direction of the intermediate transfer medium, has a container section for containing the cam, and is movable in the first or second direction by rotating of the cam; and load member for applying a load to the cam in directions opposite to moving directions of the rail member when the rail member is moved by the cam in the first and second directions, respectively.

12. The image forming apparatus according to claim 11, wherein the load member is constituted by a spring member that applies a load to the cam when the rail member is moved in the first direction by the cam.

13. The image forming apparatus according to claim 11, wherein the load member uses dead weight of the rail member to apply a load to the cam when the rail member is moved in the second direction by the cam.

14. A transfer unit movement method comprising:

providing a unit including a transfer medium that circularly moves and an image forming section along a circulation direction of the transfer medium;

moving the unit in a first direction so as to bring the unit into contact with the image forming section and in a second direction apart from the image forming section by means of a movement mechanism that moves the unit in a direction substantially perpendicular to a moving direction of the transfer medium by use of rotation of a cam; and applying a load to the cam in the directions opposite to moving directions of the unit when the unit is moved in the first and second directions, respectively, by use of rotation of a cam so as to relax impact caused by motion of the unit.

15. The transfer unit movement method according to claim 14, wherein the image forming section includes a plurality of photosensitive drums arranged in parallel with each other from an upstream side to a downstream side along the circulation direction of the transfer medium, and image formed on at least one of the plurality of photosensitive drums is transferred onto the transfer medium with the unit and the image forming section kept in contact with each other.

16. The transfer unit movement method according to claim 14, further comprising:

providing a first gear as a drive source on the body of the image forming section and a second gear provided in the unit to circularly rotate the transfer medium, wherein applying, when the unit is moved in the first direction so as to be brought into contact with the image forming section, a load to the cam in a direction opposite to the first direction so that the first and second gears are smoothly engaged with each other.

17. A transfer unit movement method comprising:

providing a transfer unit including an intermediate transfer medium that circularly moves;

providing an image forming section including plural photosensitive drums arranged in parallel with each other from an upstream side to a downstream side along a circulation direction of the intermediate transfer medium;

moving the entire transfer unit in a first direction so as to bring the transfer unit into contact with the photosensitive drums and in a second direction apart from the photosensitive drums by means of a movement mechanism that moves the unit in a direction substantially perpendicular to the moving direction of the transfer medium by use of rotation of a cam; and continuously applying a load to the cam in the directions opposite to moving directions of the transfer unit when the transfer unit is moved in the first and second directions, respectively, by use of rotation of a cam.

18. The transfer unit movement method according to claim 17, comprising:

providing a link member that can move in a third direction along the moving direction of the intermediate transfer medium in accordance with rotation of a handle so as to move the transfer unit in the first and second directions, respectively;

providing a rotating point of the cam on the body of an image forming apparatus and rotating the cam in accordance with movement of the link member;

attaching a rail member having a container section for containing the cam to the body of the image forming apparatus;

supporting the transfer unit by the rail member from both sides of the transfer unit along the moving direction of the intermediate transfer medium; and moving the rail member in the first or second direction by rotating the cam.

19. The transfer unit movement method according to claim 17, further comprising:

providing a first gear as a drive source on the body of the image forming section and a second gear in the transfer unit to circularly rotate the intermediate transfer medium; wherein when the transfer unit is brought into contact with the image forming section, the first and second gears are smoothly engaged with each other by the load.

20. A transfer unit movement method comprising:

providing a transfer unit including an intermediate transfer medium that circularly moves and an image forming section including a plurality of photosensitive drums arranged in parallel with each other from an upstream side to a downstream side along a circulation direction of the intermediate transfer medium, in which the transfer unit can be moved in a first direction so as to be brought into contact with the photosensitive drums and in a second direction apart from the photosensitive drums, the method comprising:

providing a link member that can move in a third direction along a moving direction of the intermediate transfer medium in accordance with rotation of a handle;

providing a cam rotated about a rotating point located on a body of an image forming apparatus in accordance with movement of the link member;

attaching a rail member having a container section for containing the cam to the body of the image forming apparatus;

supporting the transfer unit by the rail member from both sides of the transfer unit along the moving direction of the intermediate transfer medium;

moving the rail member in the first or second direction by rotating the cam; and applying, when the rail member is moved by the cam in the first and second directions, respectively, by the cam, a load to the cam in directions opposite to moving directions of the rail member.

* * * * *